US006674237B2

(12) United States Patent
Do et al.

(10) Patent No.: US 6,674,237 B2
(45) Date of Patent: Jan. 6, 2004

(54) PLATE FOR A PLASMA DISPLAY PANEL (PDP), METHOD FOR FABRICATING THE PLATE, AND A PDP HAVING THE PLATE

(75) Inventors: Young-rag Do, Suwon (KR); Chang-won Park, Suwon (KR); Joon-bae Lee, Kyungki-do (KR); Chaun-gi Choi, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/948,839

(22) Filed: Sep. 10, 2001

(65) Prior Publication Data

US 2002/0190652 A1 Dec. 19, 2002

(30) Foreign Application Priority Data

May 4, 2001 (KR) ..... 2001-24376

(51) Int. Cl.[7] ..... H01J 17/49
(52) U.S. Cl. ..... 313/587; 313/470
(58) Field of Search ..... 313/582, 586, 313/587, 470, 466

(56) References Cited

U.S. PATENT DOCUMENTS 4,066,924 A * 1/1978 Rublack ..... 349/44
5,414,547 A * 5/1995 Matsuo et al. ..... 430/6
5,714,286 A * 2/1998 Uchikawa et al. ..... 349/73
5,812,226 A * 9/1998 Izumi et al. ..... 345/60
5,818,162 A * 10/1998 Drumm ..... 313/484
5,892,492 A * 4/1999 Osawa et al. ..... 349/51
5,900,694 A * 5/1999 Matsuzaki et al. ..... 349/43
5,926,236 A * 7/1999 den Boer et al. ..... 345/67
5,995,175 A * 11/1999 Kim et al. ..... 430/7
6,084,559 A * 7/2000 Nagao et al. ..... 345/67
6,387,576 B2 * 5/2002 Indutnyy Z. et al. ..... 430/7

FOREIGN PATENT DOCUMENTS

| | | |
|---|---|---|
| EP | 0818799 | 1/1998 |
| EP | 1033740 | 9/2000 |
| JP | 8-212928 | 8/1996 |
| JP | 8-315735 | 11/1996 |
| JP | 9-129137 | 5/1997 |
| JP | 10-333322 | 12/1998 |
| JP | 11-96918 | 4/1999 |

* cited by examiner

*Primary Examiner*—Thomas M. Sember
*Assistant Examiner*—Dalei Dong
(74) *Attorney, Agent, or Firm*—McGuireWoods LLP

(57) ABSTRACT

A plate for a plasma display panel includes a plate member formed of a transparent material, a series of electrodes formed in a predetermined pattern on the plate member, and a dielectric layer formed on the plate member to cover the electrodes, wherein the electrodes are formed of a dielectric first component, and a metallic second component of at least one metal selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt).

28 Claims, 7 Drawing Sheets

PLATE FOR A PLASMA DISPLAY PANEL (PDP), METHOD FOR FABRICATING THE PLATE, AND A PDP HAVING THE PLATE

CROSS-REFERENCE TO RELATED APPLICATIONS

This application claims the benefit of Korean Application No. 2001-24376, filed May 4, 2001, in the Korean Industrial Property Office, the disclosure of which is incorporated herein by reference.

BACKGROUND OF THE INVENTION

1. Field of the Invention

The present invention relates to a plasma display panel (PDP), and more particularly, to a plate for a PDP on which discharging electrodes are formed, a method of fabricating the plate, and a PDP using the plate.

2. Description of the Related Art

Plasma displays generate a desired visual image by exciting a predetermined phosphor pattern with ultraviolet (UV) light generated by a plasma discharge occurring between two substrates in which a plasma gas is sealed. Such plasma displays are generally classified into a DC type and an AC type according to the corresponding driving voltage, (i.e., the discharging mechanism). AC type PDPs are further classified into two types: one is a double-substrate, two-electrode type, and the other is a surface discharge type.

For the DC type PDP, the electrodes are exposed to a discharge space and charges directly migrate between opposing electrodes. For the AC type PDP, the electrodes are covered with a dielectric layer. The plasma discharge is caused by the electric field of wall charges instead of by direct charge migration.

As an example, a surface discharging type PDP is shown in FIG. 1. Referring to FIG. 1, the PDP comprises a pair of substrates, a back plate 10 and a front plate 16. The back plate 10 comprises a series of first electrodes 11 arranged in a predetermined pattern, a dielectric layer 12 covering the first electrodes 11, and barrier walls 13 formed on the dielectric layer 12 to keep a discharge gap and to prevent electrical and optical crosstalk between cells. A fluorescent layer 19 is formed on at least one side of the discharge gap partitioned by the barrier walls 13. The front plate 16 comprises transparent second third electrodes 14 and 15, and bus electrodes 14*a* and 15*a*, which are narrow and arranged on the corresponding transparent second and third electrodes 14 and 15 to reduce line resistance. The front plate 16 further comprises a black matrix 20 formed between each pair of the transparent and third electrodes 14 and 15 to enhance the contrast of the image, a dielectric layer 17, and a protective layer 18 covering all electrodes 14, 15, 14*a*, and 15*a* and the black matrix 20.

In a conventional PDP such as that disclosed in Japanese Laid-open Patent Publication No. hei 8-315735 and shown in FIG. 2, surface discharging electrodes 30*a* and 30*b* are arranged on at least one side of a surface discharging electrode region 30. The surface discharge electrodes 30*a* and 30*b* are partially and linearly divided in the longitudinal direction, and the divided surface discharging electrodes 30*a* and 30*b* are electrically connected by a plurality of electrode portions 31. The pairs of surface discharge electrodes 30*a* and 30*b* define a corresponding discharge gap 33 therebetween. A black matrix 34 is formed between adjacent pairs of the electrodes 30*a* and 30*b*.

Another conventional PDP such as that disclosed in Japanese Laid-open Patent Publication No. hei 9-129137 and shown in FIG. 3 includes a plurality of row electrodes 40, which extend parallel to each other in the horizontal direction and are arranged with a discharge gap 41 therebetween, and a plurality of column electrodes 42 extending from adjacent row electrodes 40, with a separation gap therebetween and opposite each other to form a light-emitting pixel region 44. There is also a light-emitting pixel region 43 with a narrower discharge gap than the light-emitting pixel region 44. A black matrix 46 is formed between adjacent pairs of the row electrodes 40.

As described above, in the conventional surface discharge AC type PDP, the electrodes arranged on the front plate 16 include the bus electrodes 14*a* and 15*a* formed of silver (Ag) paste, and transparent second and third electrodes 14 and 15 formed of indium tin oxide (ITO), or has a structure divided in the longitudinal direction using the Ag paste. Also, the black matrixes 20, 34, and 46 arranged between each pair of electrodes 14, 15, 30*a*, 30*b* and 40, which are paired to cause a discharge of plasma therebetween, are formed of a mixture of a black pigment and an insulating material.

To manufacture an optimal front plate capable of maximizing the function of a PDP as described above, the electrodes and the black matrix should be formed of appropriate materials (i.e., materials having different physical properties). For this reason, there is a need for separate patterning processes for the electrodes and the black matrix. However, the separate patterning processes complicate the overall manufacturing process.

For example, to manufacture the front plate 16 shown in FIG. 1 using the process in FIG. 4 for a front plate 16 that includes the bus electrodes 14*a* and 15*a* and the second and third electrodes 14 and 15 formed as ITO electrodes, a bare front plate is cleaned, and an ITO layer is deposited on the front plate 16 by a sputtering operation 100. Then, the second and third electrodes 14 and 15 are patterned for discharging as shown in operation 102. For this patterning process, a positive photoresist is deposited on the ITO layer, and is then exposed and etched using a predetermined mask pattern. After the ITO electrodes 14 and 15 are formed, bus electrodes 14*a* and 15*a* are printed on corresponding ITO electrodes 14 and 15 using the Ag paste, which are then dried and sintered to completely form the bus electrodes 14*a* and 15*a* in operations 104 and 106. After forming the bus electrodes 14*a* and 15*a*, the black matrix 20 is printed using a mixture of a black pigment and an insulating material in operation 108.

In the front plate manufacturing method described above, since the electrodes 14 and 15 and black matrix 20 are formed through separate operations 100–106 and 108, the number of working steps increases, which increases the likelihood of failure, thereby lowering productivity. In particular, in the case where the electrodes 14 or 15 of the front plate 16 are exclusively formed of metal, there are problems in that external light is reflected due to low external-light absorbency, and the black matrix 20 cannot be formed as fine patterns.

SUMMARY OF THE INVENTION

To solve the above and other problems, it is an object of the present invention to provide a plate for a plasma display panel (PDP), where the electrodes and a black matrix have good adhesiveness with respect to a plate member and improved mechanical characteristics due to the absence of internal stress.

It is an additional object of the present invention to provide a method of fabricating a plate for a PDP in which electrodes and a black matrix can be formed through simple processes so that productivity is improved.

It is a further object of the present invention to provide a PDP with enhanced brightness and contrast characteristics by using a plate on which electrodes and a black matrix are formed.

Additional objects and advantages of the invention will be set forth in part in the description which follows and, in part, will be obvious from the description, or may be learned by practice of the invention.

To achieve the above and other objects, a plate for a plasma display panel (PDP) according to an embodiment of the present invention includes a plate member formed of a transparent material, a series of electrodes formed in a predetermined pattern on the plate member, and a dielectric layer formed on the plate member to cover the electrodes, wherein the electrodes are formed of a dielectric first component and a second component of at least one selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt).

According to an aspect of the present invention, the plate of the PDP further includes a black matrix pattern formed between each of the electrodes.

According to another embodiment of the present invention, a method of fabricating a plate for a plasma display panel (PDP) includes preparing a transparent plate member, depositing into a single deposition boat a mixture of 3–50% SiO by weight as a dielectric material and 50–97% by weight of at least one metal selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt), wherein the dielectric material and metal have different melting points, loading the plate member into a vacuum chamber, and depositing the SiO and metal on the plate member while gradually raising the temperature of the deposition boat, patterning the deposited SiO and metal into electrodes and a black matrix pattern by photolithography, and forming a dielectric layer on the plate member on which the electrodes and the black matrix pattern are formed.

According to a further embodiment of the present invention, a plasma display panel includes a back plate, first electrodes formed in a predetermined pattern on the back plate, a transparent front plate bonded with the back plate having the first electrodes to form a discharge space therebetween, second and third electrodes formed on one side of the front plate opposite the first electrodes at a predetermined angle with respect to a direction of the first electrodes, a barrier to partition the discharge space between the back plate and front plate, a first dielectric layer formed on the back plate to cover the first electrodes, a second dielectric layer formed on the front plate to cover the second and third electrodes, and a black matrix pattern formed between each pair of the second and third electrodes on the one side of the front plate, wherein the black matrix pattern and one of the first electrodes, or the second, and the third electrodes comprise a dielectric material and a conductive metal, and amounts of the dielectric material and conductive metal change as a function a thickness of the electrodes and black matrix pattern extending into the discharge space.

According to an additional embodiment of the present invention, a PDP includes a back plate, a transparent front plate bonded with the back plate with a predetermined separation gap to form a discharge space therebetween, first and second electrodes arranged on a side of at least one of the back plate and front plate to cause a discharge of a plasma, and a discharge gas with which the discharge space is filled, wherein the first and second electrodes include a dielectric first component and a metallic second component of at least one selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt).

According to yet another embodiment of the present invention, a PDP includes a back plate, first electrodes formed in a predetermined pattern on the back plate, a transparent front plate bonded with the back plate having the first electrodes to form a discharge space therebetween, second and third electrodes formed on one side of the front plate opposite the first electrodes at a predetermined angle with respect to a direction of the first electrodes, a barrier to partition the discharge space between the back plate and the front plate, a first dielectric layer formed on the back plate to cover the first electrodes, a second dielectric layer formed on the front plate to cover the second and third electrodes, and a black matrix pattern formed between adjacent pairs of the second and third electrodes on the one side of the front plate, wherein the black matrix pattern and one of the first electrodes, the second, and the third electrodes are formed of a dielectric first component and a metallic second component of at least one selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt).

According to an aspect of the present invention, the dielectric first component may comprise at least one dielectric material selected from a group consisting of $SiO_x$, $MgF_2$, $CaF_2$, $Al_2O_3$, $SnO_2$, $In_2O_3$, and ITO, where $x \geqq 1$.

BRIEF DESCRIPTION OF THE DRAWINGS

The above objects and advantages of the present invention will become more apparent and more readily appreciated by describing in detail preferred embodiments thereof with reference to the accompanying drawings in which.

DETAILED DESCRIPTION OF THE PREFERRED EMBODIMENTS

Figure 1:
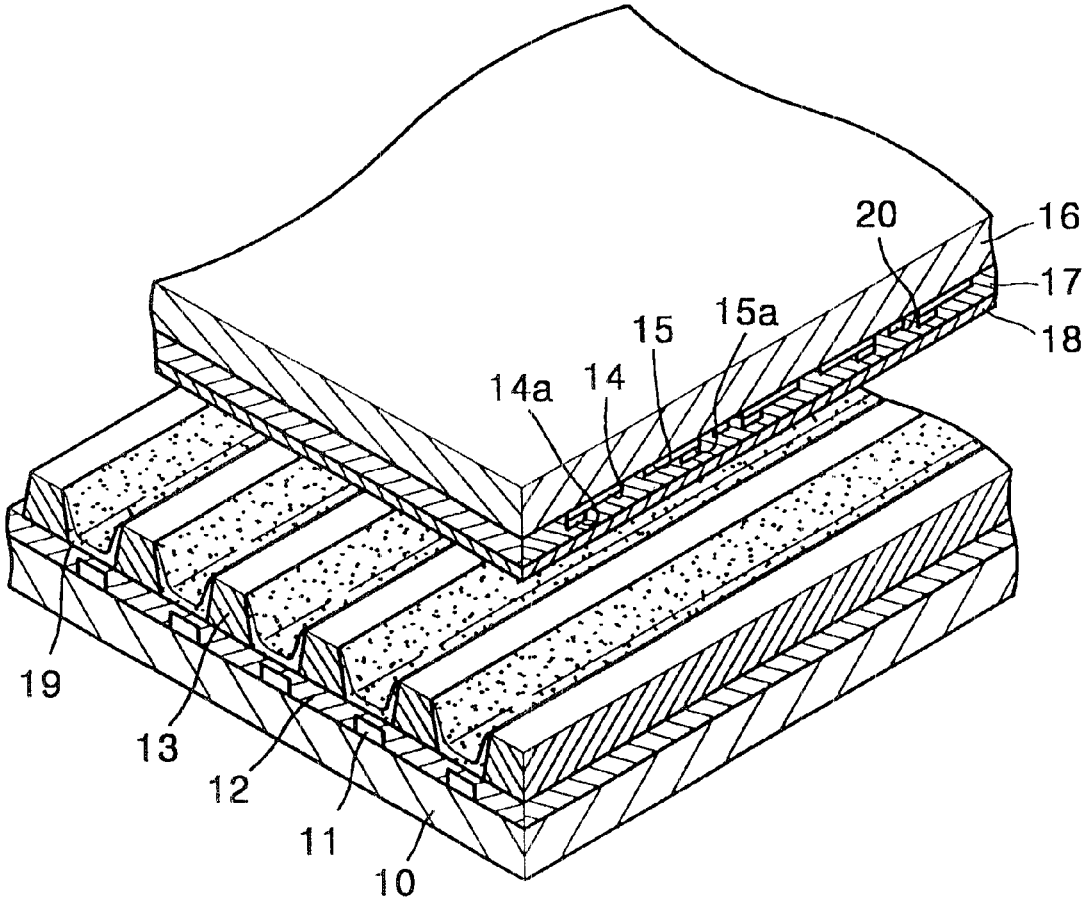
FIG. 1 (PRIOR ART)
FIG. 1 is an exploded perspective view of a conventional plasma display panel (PDP)
Figure 2:
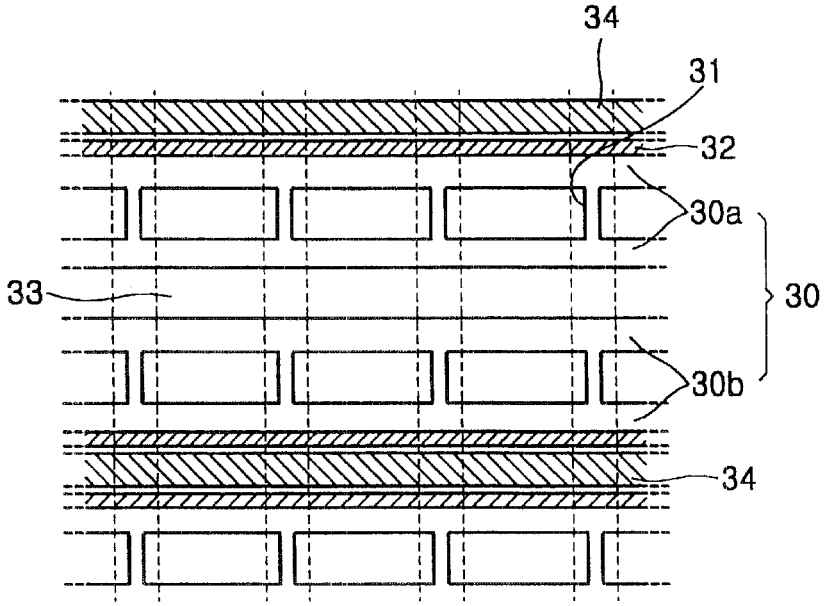
FIG. 2 (PRIOR ART)
FIGS. 2 and 3 are plan views of conventional PDPs showing the arrangement of second and third electrodes and bus electrodes.
Figure 3:
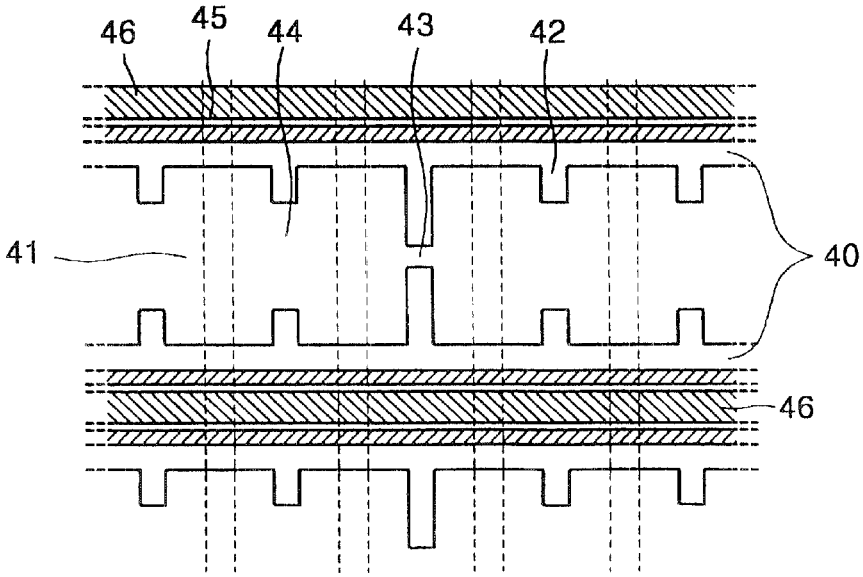
FIG. 3 (PRIOR ART)
Figure 4:
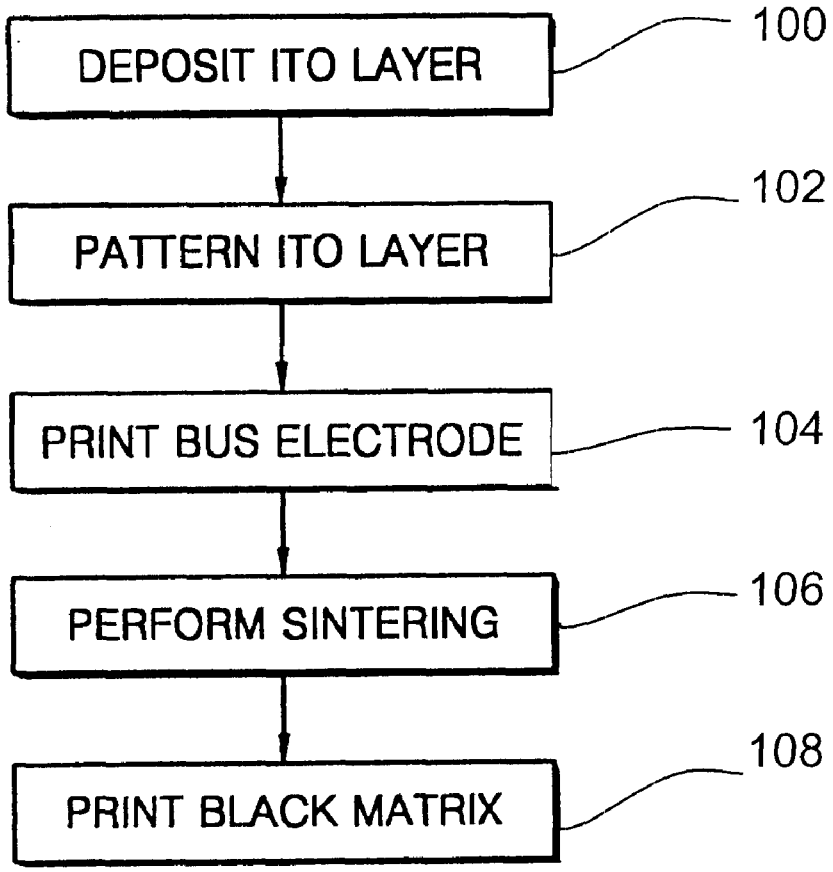
FIG. 4 (PRIOR ART)
FIG. 4 is a flowchart illustrating a conventional method of forming electrodes and a black matrix for a front panel.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

A plasma display panel (PDP) according to the present invention includes a back plate bound to a front plate to define a discharge space filled with a discharge gas therebetween. The PDP creates images by exciting phosphor with ultraviolet (UV) rays generated through the discharge of plasma by electrode pairs located in the discharge space. Such PDPs are classified into various types according to the number of the electrodes, the arrangement of the electrodes, the discharge site, or the type of applied voltage such as AC and DC. A PDP according to an embodiment of the present invention is shown in FIG. 5.

Figure 5:
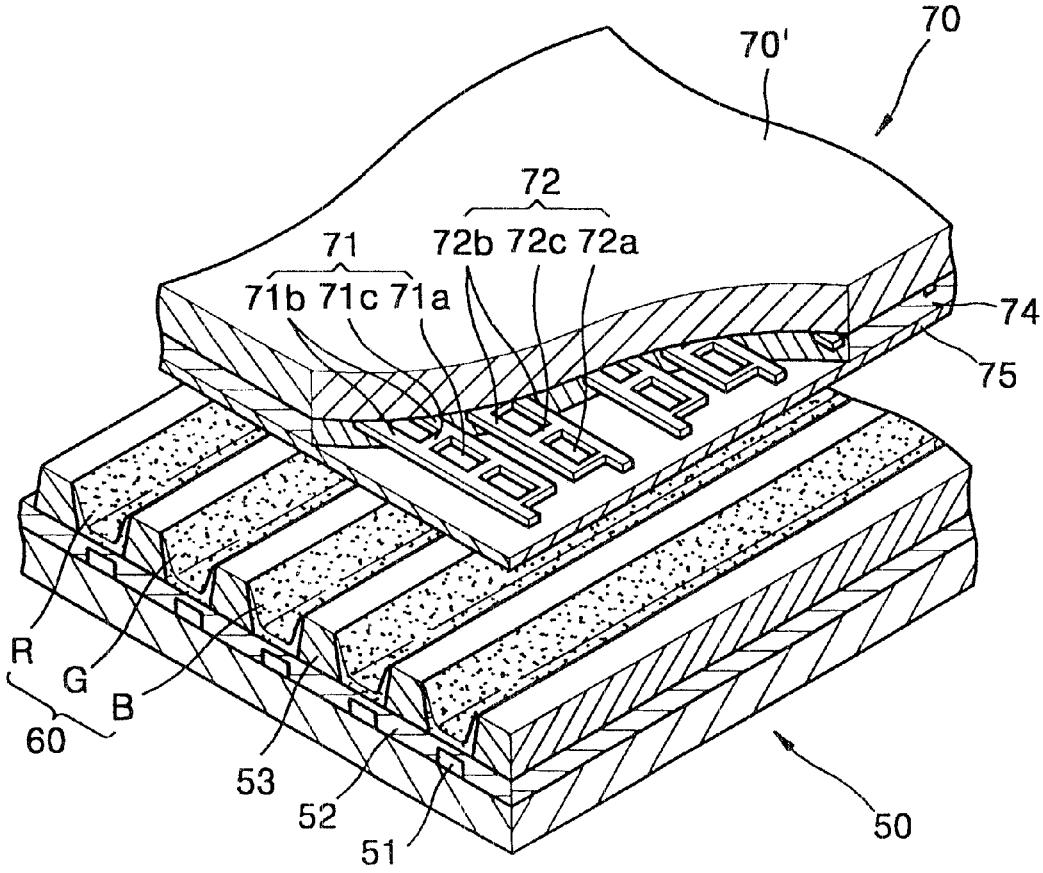
FIG. 5 is an exploded perspective view of a PDP according to an embodiment of the present invention.

Referring to FIG. 5, first electrodes 51 are formed in a stripe pattern on a back plate 50 with a predetermined separation gap therebetween. A first dielectric layer 52 is formed on the back plate 50 to fill the first electrodes 51. Barrier walls 53 having a predetermined height are formed in lines and parallel to the first electrodes 51 with a predetermined separation gap therebetween. The shape of the barrier walls 53 is not limited to lines, and may be formed as a lattice or any other shape that inhibits cross-talk between cells. Red (R), green (G), and blue (B) phosphors are alternately deposited between adjacent pairs of the barrier walls 53 to form a fluorescent layer 60. It is understood that the arrangement of R, G, and B phosphors in the fluorescent layer 60 is not limited to this arrangement, and any arrangement that allows the formation of a color image can be used.

Figure 6:
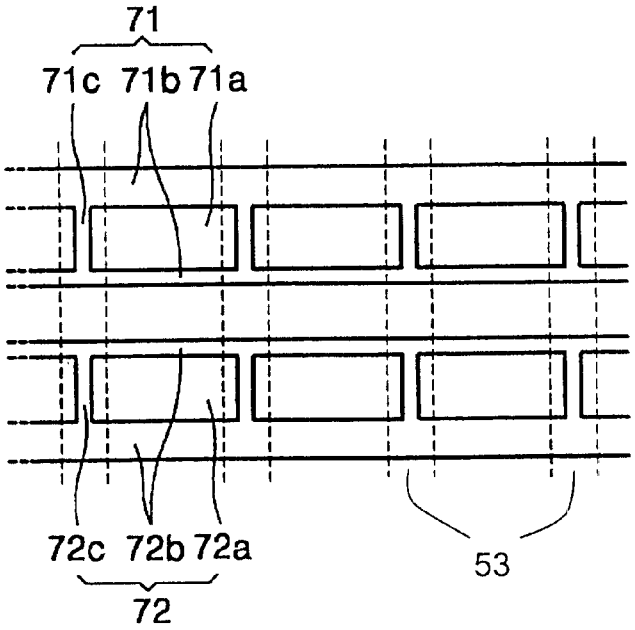
FIGS. 6 and 7 are plan views of the arrangement of second and third electrodes for a plate of the PDP according embodiments of to the present invention.

The back plate 50 having the barrier walls 53 is combined with a front plate 70 to using a seal to seal each partitioned discharge space partitioned by the barrier walls 53. Second and third electrodes 71 and 72 are arranged on the inner surface of the front plate 70, which is opposite the barrier walls 53 of the back plate 50. The second and third electrodes 71 and 72 are in a predetermined pattern and are perpendicular to a direction of the first electrodes 51. The second and third electrodes 71 and 72 are alternately arranged, and each pair of the second and third electrodes 71 and 72 is located in one pixel region. As shown in FIG. 6, according to an embodiment of the present invention, the second and third electrodes 71 and 72 include parallel main electrode parts 71*b* and 72*b*, and connect electrode parts 71*c* and 72*c* that are perpendicular to the corresponding main electrode parts 71*b* and 72*b*. Accordingly, the second and third electrodes 71 and 72 have apertures 71*a* and 72*a*, which are rectangular. It is preferable that the apertures 71*a* and 72*a* of each pair of the second and third electrodes 71 and 72 are arranged in each light-emitting discharge space.

Figure 7:
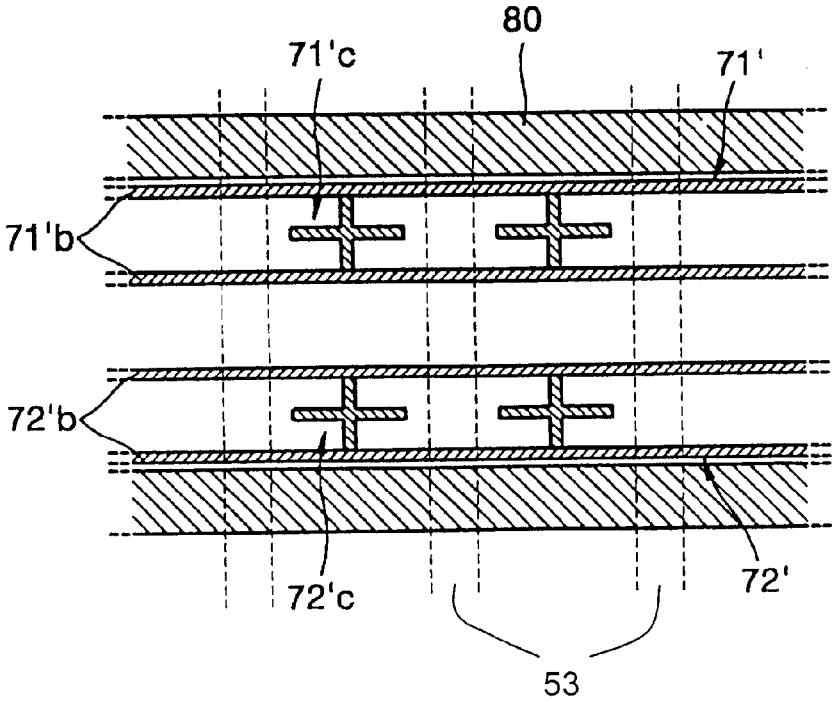

However, it is understood that the arrangement of the apertures 71*a* and 71*a* is not limited to the shown arrangement and can be appropriately modified within the scope of the present invention. It is also appreciated that the second and third electrodes 71 and 72 may be modified into various forms. For example, the second and third electrodes 71 and 72 may be formed as indium thin oxide (ITO) electrodes and use corresponding bus electrodes along the same. Alternatively, the second and third electrodes 71 and 72 may be formed of parallel metal electrodes and auxiliary electrodes formed of ITO, where the auxiliary electrodes extend from each of the parallel metal electrodes towards each other. As shown in FIG. 7, according to an embodiment of the present invention, the second and third electrodes 71' and 72' may include parallel main electrodes parts 71'*b* and 72'*b* having a narrow width, and connect electrode parts 71'*c* and 72'*c* having an element parallel with the main electrode parts 71'*b* and 72'*b*, which connect the parallel main electrode parts 71'*b* and 72'*b*, respectively.

According to an embodiment of the present invention shown in FIG. 7, a black matrix pattern 80 to enhance the brightness and the contrast of a display image is formed between adjacent pairs of the second and third electrodes 71 and 72. A second dielectric layer 74 and a protective layer 75 of magnesium oxide (MgO) are formed to cover the second and third electrodes 71 and 72 and the black matrix pattern 80 of the front plate 70. However, it is understood that the black matrix pattern 80 is not required in all aspects of the present invention.

The second and third electrodes 71 (71') and 72 (72') and the black matrix pattern 80 are formed of a dielectric (first) component, and a metallic (second) component. The second component is at least one selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt). The first component includes at least one dielectric material selected from a group consisting of $SiO_x$ (where $x \geqq 1$), $MgF_2$, $CaF_2$, $Al_2O_3$, $SnO_2$, $In_2O_3$, and ITO.

The concentrations of the first and second components vary for the second and third electrodes 71 and 72 and the black matrix pattern 80. The concentration of the dielectric component gradually decreases from an external light entering side toward the inner side of the front plate 70 adjacent to the back plate 50, or has a step gradient distribution. In addition, the metallic component gradually increases toward the inner side of the front plate 70. The amounts of the dielectric and metallic components are almost the same in the middle of each of the second and third electrodes 71 and 72 and the black matrix pattern 80.

Figure 8:
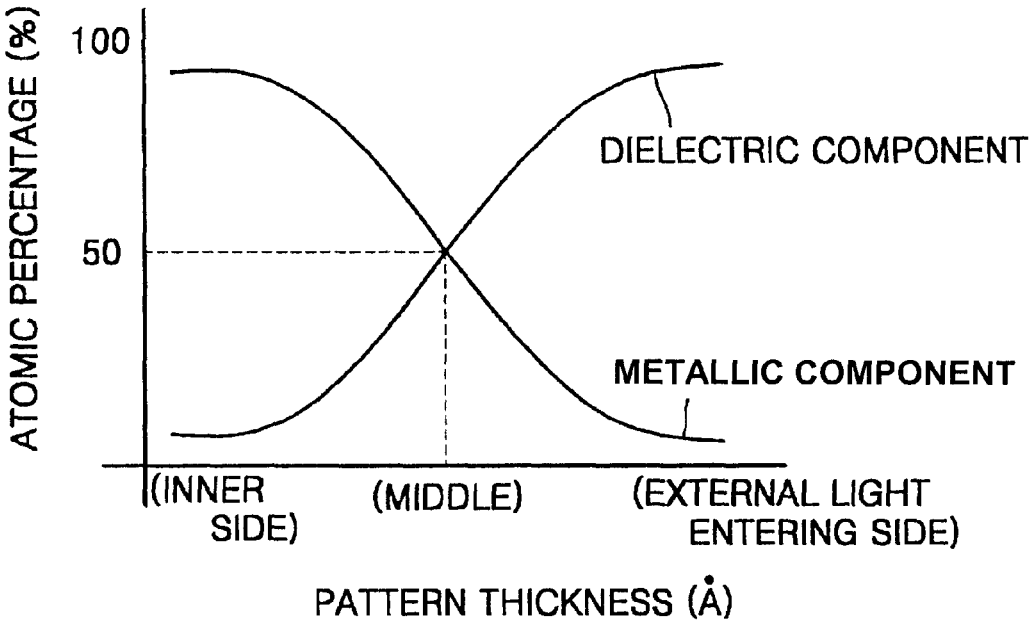
FIGS. 8 through 11 show changes in concentrations of the first and second components in a thickness direction of the electrodes and the black matrix.
Figure 9:
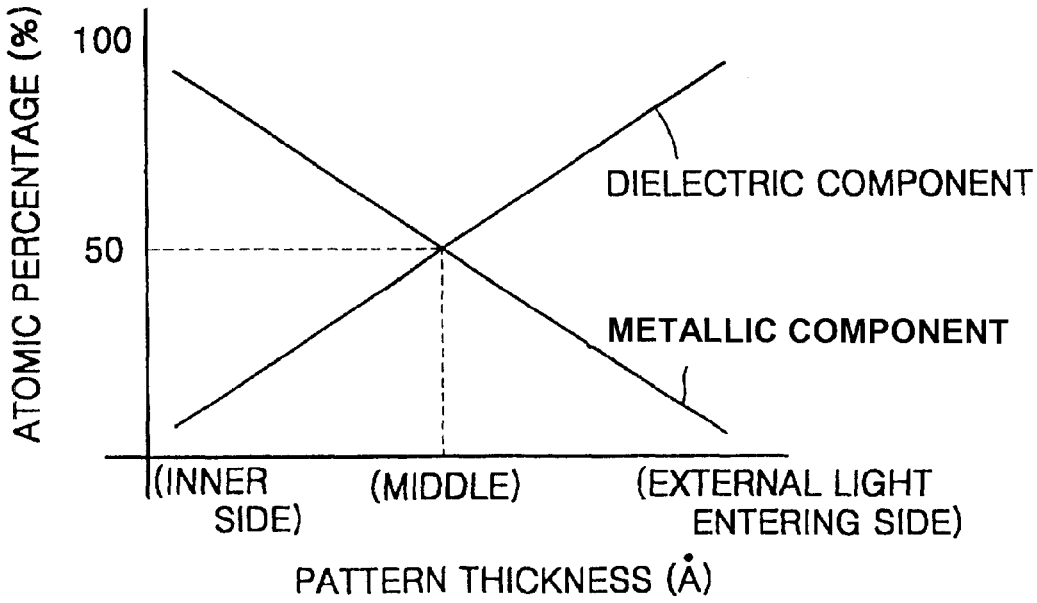

According to the present invention, either the second and third electrodes 71 and 72 and the black matrix pattern 80, or the second and third electrodes 71 and 72 alone without the black matrix pattern 80, are formed by slowly depositing the dielectric material and the metal to have reciprocal concentration profiles as shown in FIGS. 8 and 9. Thus, a layered structure is not formed, and the external light is absorbed, rather than reflected, at the interface between the black matrix pattern 80 and a plate member 70' through which the external light enters the front plate 70. The external light is absorbed due to changes in the refractivity of the black matrix pattern 80 caused by variations in the concentrations of the dielectric and metallic components.

For the second and third electrodes 71 and 72 and the black matrix pattern 80 described above, the plate member 70' of the front plate 70, which is formed of $SiO_2$, has an index of refraction of about 1.5, which is almost the same as that of the dielectric material forming a portion of the black matrix pattern adjacent to the plate member 70'. Accordingly, external light is transmitted, rather than reflected, at the interface between the plate member 70' and the black matrix pattern. The index of refraction of the black matrix pattern is gradually increased and the transmittance is decreased toward the inner side of the front plate 70 due to the gradient of the concentration profile of the black matrix pattern. Thus, almost all the external light is absorbed, rather than reflected, by the black matrix pattern 80.

Meanwhile, the second and third electrodes 71 and 72 having the concentration profile of the first and second components described above absorb some of the visible light generated by excitation of the fluorescent layer so that an opening ratio of the discharge space drops. However, since the second and third electrodes 71 and 72 for a front plate 70 according to the present invention are formed to have a mesh-type structure, or are formed as transparent electrodes having narrow bus electrodes thereon, a decrease in brightness caused by a sudden drop of the opening ratio is prevented. In particular, for the second and third electrodes 71 and 72 having the concentration profile described above, the concentration of the dielectric (first) component gradually decreases and that of the metallic (second) component gradually increases with increased distance from the external light entering side of the front plate 70. As a result, the surfaces of the second and third electrodes 71 and 72 facing the discharge space exclusively contain the metal component to a predetermined depth so that the conductivity is improved with a sheet resistance of 0.1Ω/□ or less. Thus, the second and third electrodes 71 and 72 for a plate according to the present invention satisfy requirements for the discharging electrodes of PDPs.

The front plate 70 for a PDP which has either second and third electrodes 71 and 71 and a black matrix pattern 80, or the second and third electrodes 71 and 72 serving also as the black matrix pattern 80 without using a black matrix pattern 80 having the non-uniform composition described above can be manufactured through the following processes.

A plate member 70' for the front plate 70 is cleaned, and then loaded and fixed into a vacuum chamber opposite a deposition boat. Next, a mixture of the dielectric material and the metal having different melting points (i.e., the first and second components) is put into the deposition boat. According to an embodiment of the present invention, the mixture of the dielectric material and metal includes 50–97% of the second component by weight, which is at least one metal selected from a group consisting of Fe, Co, V, Ti, Al, Ag, Si, Ge, Y, Zn, Zr, W, Ta, Cu, and Pt, and 3–50% of the first component by weight, which is at least one dielectric material selected from a group consisting of $SiO_x$ (where $x \geqq 1$), $MgF_2$, $CaF_2$, $Al_2O_3$, $SnO_2$, $In_2O_3$, and ITO.

Next, vacuum thermal deposition is performed by varying the temperature of the deposition boat in which the mixture of the metal and dielectric material is contained. Here, the temperature of the deposition boat is varied by gradually increasing the level of voltage applied to the same. As the temperature of the deposition is gradually increased and time passes, the deposition of the dielectric component starts. Next, both the dielectric component and metallic component are then deposited at a higher temperature. In the final stage of depositing at a highest temperature, none of the dielectric component remains, and so the metallic component is exclusively deposited. As a result, as shown in FIGS. 8 and 9, the dielectric component and the metallic component have the same concentration at a predetermined depth from the external light entering side of the front plate 70, and then the amount of the dielectric component becomes less and the amount of the metallic component becomes greater. However, it is understood that the initial and/or final stages need not be exclusively of the dielectric material or metal component in all circumstances.

For this dielectric-metal deposition process, the deposition of the metallic component is achieved by melting, rather than by vaporization. In particular, at least one metallic component selected from the group consisting of Fe, Co, V, Ti, Al, Ag, Si, Ge, Y, Zn, Zr, W, Ta, Cu, and Pt has a different phase diagram from that of chromium (Cr). Cr is immediately sublimated by heat, but the above-listed metallic components are melted and changed into the liquid state by the application of heat. The dielectric component mixed with a liquid metallic component sublimates to be deposited on a plate member 70' of a PDP. Since the dielectric component sublimates while being mixed with the liquid metallic component, a problem that limits mass production caused by the dielectric particles going out of the deposition boat can be prevented.

The concentration profile of the electrodes and the black matrix pattern varies depending on the initial particle size of the dielectric component. More specifically, if a dielectric material has a particle size as small as about 0.5 mm, the total surface area of the dielectric material increases and its contact surface area with the deposition boat also increases during thermal deposition. The smaller the particle size of the dielectric material, the lighter the weight of the dielectric particles. As a result, a jet flow occurs due to the instantaneously increased vapor pressure caused by thermal conduction so that the dielectric particles go out of the deposition boat, which facilitates the vaporization of the dielectric particles.

In contrast, if a dielectric material has a particle size as large as about 2 mm, the dielectric particles are not affected by the jet flow, but the amount of the dielectric material to be deposited is small as compared to the total volume of the dielectric material loaded into the deposition boat. As a result, when the particle size of the dielectric component in the mixture of the metallic and dielectric components is adjusted to be within the range of 1–1.5 mm, the second and third electrodes 71 and 72 and the black matrix pattern having optimal optical and electric characteristics can be formed.

When the deposition of the dielectric material and metal is completed, as described above, the resultant thin film deposited on the plate member 70' is patterned by photolithography to complete the formation of either the second and third electrodes 71 and 72 and a black matrix pattern 80, or the second and third electrodes 71 and 72 serving also as the black matrix pattern 80 for the front plate 70 according to the present invention. The deposition of the thin film having the concentration profile of the first and second components is not limited to using the vacuum chamber, and other methods, such as sputtering or electron beam deposition may be used to deposit the thin film.

For photolithography, a direct photolithography method or blast photolithography method may be used. According to the direct photolithography method, a positive photoresist is applied to the deposited thin film, exposed through a shadow mask, and is developed into a photoresist pattern. Next, a predetermined region of the deposited thin film is etched using the photoresist pattern, and the remaining photoresist pattern is removed, thereby forming either the second and third electrodes 71 and 72 and a black matrix pattern 80 or only the second and third electrodes 71 and 72 serving also as the black matrix pattern 80.

For the blast photolithography method, a photoresist is applied to the deposited thin film, and exposed and developed into a photoresist pattern. A black coated layer is formed on the photoresist pattern, and any unnecessary amounts of the black coated layer and the photoresist pattern are removed by etching, thereby forming either the second and third electrodes 71 and 72 and a black matrix pattern 80 or only the second and third electrodes 71 and 72 serving also as the black matrix pattern 80. However, it is understood that other methods of microfabrication can be used to pattern the electrodes 71 and 72 and/or the black matrix pattern 80.

The present invention will be described in greater detail using the following examples. The following examples are for illustrative purposes and are not intended to limit the scope of the invention or the equivalents thereof. For Examples 1 through 9, the electrodes and the black matrix pattern are formed on the plate by deposition. For Examples 10 through 13, the electrodes and the black matrix pattern are formed on the plate by sputtering.

EXAMPLE 1

160 mg of a mixture of 25% SiO by weight having a particle size of 1.5 mm and 75% Fe by weight was put into a deposition boat, and the distance between the deposition boat and a plate member was adjusted to 18.5 cm.

The plate member was loaded into a vacuum chamber, and the degree of vacuum was kept at $2\times10^{-3}$ Pa. A black coated layer having a thickness of 400 nm was deposited on the plate member while varying the temperature of the deposition boat.

After forming the black coated layer on the plate member, an organic positive photoresist was deposited thereon using a centrifuge and exposed through a shadow mask with ultraviolet (UV) rays. The resultant structure was developed and the non-exposure region of the photoresist layer was cured to form a photoresist pattern. The black coated layer was patterned using the photoresist pattern. After cleaning with deionized water, the photoresist pattern was stripped off, resulting in either the second and third electrodes and the black matrix pattern, or the second and third electrodes serving also as the black matrix pattern.

EXAMPLE 2

The black matrix pattern was formed in the same manner as in Example 1, except that the particle size of SiO was 1 mm, and 200 mg of the mixture of SiO and iron (Fe) was put into the deposition boat.

EXAMPLE 3

The black matrix pattern was formed in the same manner as in Example 1, except that 220 mg of a mixture of 40% SiO by weight having a particle size of 1 mm and 60% titanium (Ti) by weight was put into the deposition boat.

EXAMPLE 4

The black matrix pattern was formed in the same manner as in Example 1, except that 210 mg of a mixture of 40% SiO by weight having a particle size of 1 mm, 10% Ti by weight, and 50% Fe by weight was put into the deposition boat.

EXAMPLE 5

The black matrix pattern was formed in the same manner as in Example 1, except that 210 mg of a mixture of 40% SiO by weight having a particle size of 1 mm, 50% Ti by weight, and 10% Fe by weight was put into the deposition boat.

EXAMPLE 6

The black matrix pattern was formed in the same manner as in Example 1, except that 210 mg of a mixture of 20% SiO by weight having a particle size of 1 mm, 70% Ti by weight, and 10% Fe by weight was put into the deposition boat.

EXAMPLE 7

The second and third electrodes and the black matrix pattern or the second and third electrodes serving also as the black matrix pattern were formed in the same manner as in Example 1, except that a first deposition boat containing 210 mg of a mixture of 20% SiO by weight having a particle size of 1 mm, 70% Ti by weight, and 10% Fe by weight, and a second deposition boat containing 240 mg of Al were used. After deposition of the mixture, an Al film was in-situ deposited to lower the sheet resistance.

EXAMPLE 8

The black matrix pattern was formed in the same manner as in Example 1, except that 210 mg of a mixture of 20% SiO by weight having a particle size of 1 mm, and 80% vanadium (V) by weight was put into the deposition boat.

EXAMPLE 9

The black matrix pattern was formed in the same manner as in Example 1, except that a first deposition boat containing 210 mg of a mixture of 20% SiO by weight having a particle size of 1 mm and 80% V by weight and a second deposition boat containing 240 mg of Al were used. After deposition of the mixture, an Al film was in-situ deposited to lower sheet resistance.

The black matrix patterns formed in Examples 1 through 9 were observed using an optical microscope. As a result, the second and third electrodes and the black matrix pattern or second and third electrodes serving also as the black matrix pattern formed in Examples 1 through 5 correspond in size and shape to the shadow mask used for exposure and have sharp edges.

Meanwhile, the electric and optical characteristics were evaluated for the second and third electrodes serving also as the black matrix pattern, or the second and third electrodes and the black matrix pattern formed in Examples 1 through 9. The results are shown in Table 1. In Table 1, R represents sheet resistance, $R_m$ represents mirror reflectivity, and $R_d$ represents diffused reflectivity.

TABLE 1

| Example | Composition (% by weight) | R (Ω/□) | $R_m$ (%) | $R_d$ (%) | Optical Density | Black Matrix quality |
|---|---|---|---|---|---|---|
| Example 1 | SiO:Fe = 25:75 | 300 | 1.3 | 0.08 | 3.5 | achromatic black |
| Example 2 | SiO:Fe = 25:75 | 745 | 1.2 | 0.09 | 3.5 | achromatic black |
| Example 3 | SiO:Ti = 40:60 | 620 | 1.1 | 0.09 | 4 | achromatic black |
| Example 4 | SiO:Fe:Ti = 40:10:50 | 500 | 0.9 | 0.08 | 3.8 | achromatic black |
| Example 5 | SiO:Fe:Ti = 40:50:10 | 2000 | 1 | 0.09 | 3.8 | achromatic black |
| Example 6 | SiO:Fe:Ti = 20:10:70 | 30 | 0.8 | 0.05 | 4.0 | achromatic black |
| Example 7 | SiO:Fe:Ti = 20:10:70 & Al layer | 0.1 | 0.8 | 0.06 | 4.5 | achromatic black |
| Example 8 | SiO:V = 20:80 | 10 | 0.9 | 0.05 | 4.3 | achromatic black |
| Example 9 | SiO:V = 20:80 & Al layer | 0.08 | 0.9 | 0.04 | 4.7 | achromatic black |

As shown in Table 1, the second and third electrodes and, optionally, the black matrix pattern formed in Examples 1 through 9 are in achromatic black, have a mirror reflectivity of about 1%, and have a diffused reflectivity of 0.08–0.09%. The second and third electrodes and the optional black matrix pattern can have a sheet resistance of 1 Ω/□ or less by adjusting the amount of the metal. The optical density of the second and third electrodes and the optional black matrix pattern is about 4.0. It is evident that the reflectivity, the resistance, and the optical density characteristics of the black matrix pattern and the second and third electrodes are appropriate for a PDP.

For front plates having the black matrix pattern and the second and third electrodes formed in Examples 1 through 9, the striped patterns of the black matrix and second and third electrodes were observed using an optical microscope. As a result of these observations, it is apparent that the black matrix pattern and the second and third electrodes have good surface flatness and may be formed of fine patterns of 1 $\mu$m or less. In other words, the second and third electrodes can be formed as a meshed pattern or as a plurality of parallel line electrodes which are electrically connected and have a separation gap therebetween to the extent that transmittance is not reduced.

EXAMPLE 10

Figure 10:
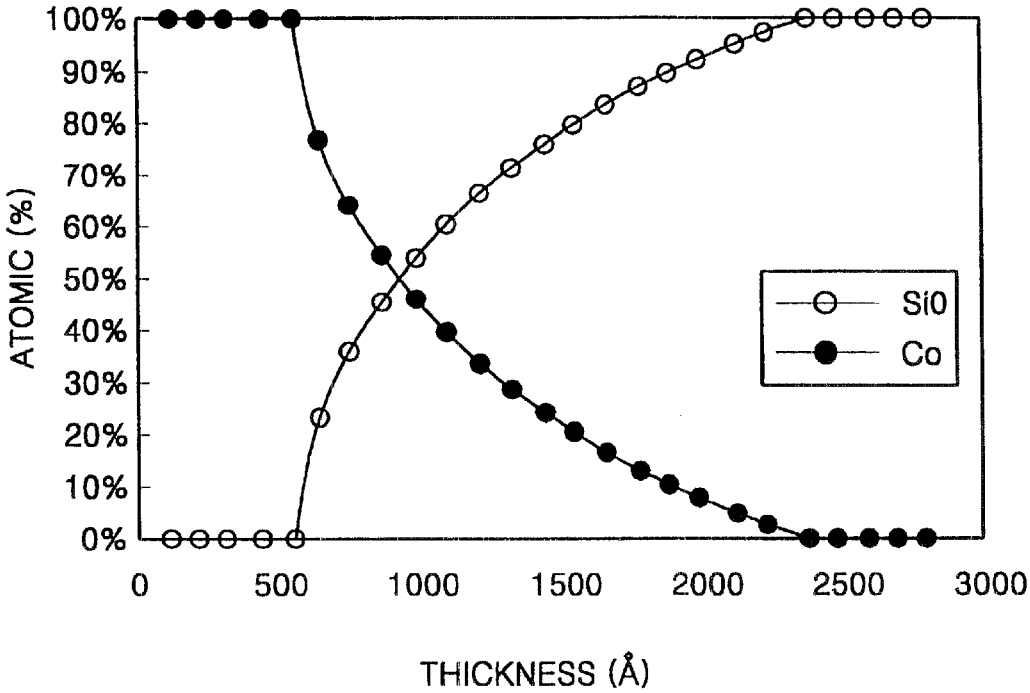

The black coated layer was deposited to have a thickness of 3,000 Å on the surface of the plate member by sputtering in a vacuum chamber such that the resultant black coated layer had gradient concentrations of $SiO_x$ and Co as shown in FIG. 10. After the black coated layer was formed on the plate member, an organic positive photoresist was deposited on the surface of the black coated layer using a centrifuge and then exposed to UV light through a shadow mask. The resultant structure was developed and the unexposed regions were cured to form a photoresist pattern. The black coated layer was patterned using the photoresist pattern. After cleaning with deionized water, the photoresist pattern was stripped off to form the second and third electrodes and the optional black matrix pattern.

EXAMPLE 11

Figure 11:
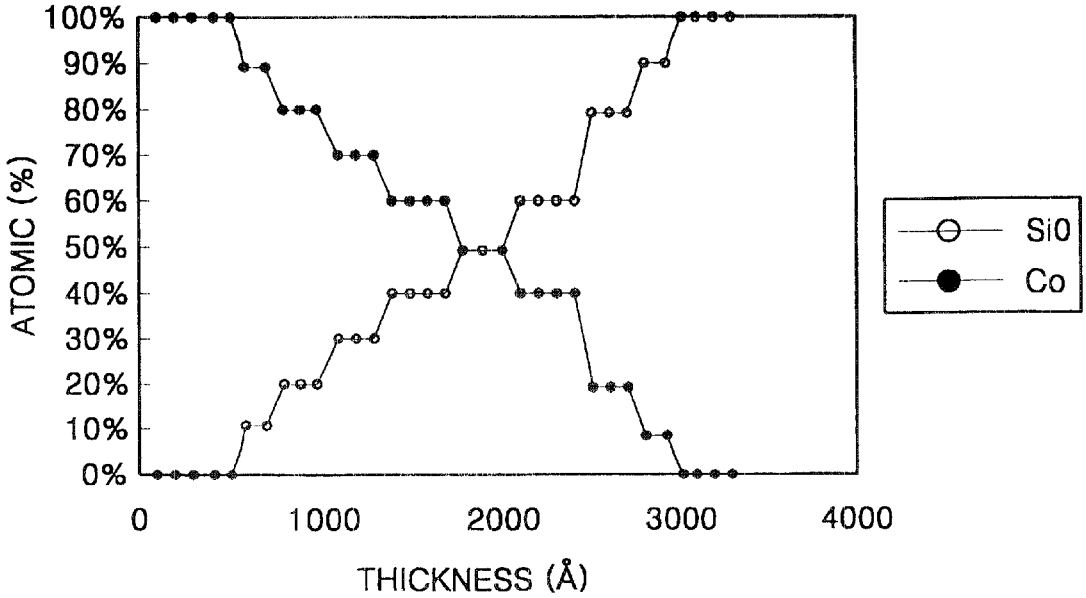

The second and third electrodes and the optional black matrix pattern or the second and third electrodes serving also as the black matrix pattern were formed in the same manner as in Example 10, except that the black coated layer deposited by sputtering had a thickness of 3,300 Å formed in 10 step gradients of $SiO_x$ and Co as shown in FIG. 11.

EXAMPLE 12

The second and third electrodes and the optional black matrix pattern were formed in the same manner as in Example 10, except that the black coated layer deposited by sputtering had a thickness of 3,200 Å formed in 5 step gradients of $SiO_x$ and Co.

EXAMPLE 13

The second and third electrodes and the black matrix pattern or second and third electrodes serving also as the black matrix pattern were formed in the same manner as in Example 10, except that the black coated layer deposited by sputtering had a thickness of 3,200 Å formed in 3 step gradients of $SiO_x$ and Co.

The electrical and optical characteristics were evaluated for the second and third electrodes and the optional black matrix pattern. The results are shown in Table 2. In Table 2, R represents sheet resistance, $R_m$ represents mirror reflectivity, and $R_d$ represents diffused reflectivity.

TABLE 2

| Example | R (Ω/□) | $R_m$ (%) | $R_d$ (%) | Thickness (Å) | Optical Density | Black Matrix quality |
|---|---|---|---|---|---|---|
| Example 10 | 300 | 1.3 | 0.05 | 3000 | 3.5 | achromatic black |
| Example 11 | 745 | 1.5 | 0.5 | 3300 | 3.5 | achromatic black |
| Example 12 | 620 | 1.4 | 0.6 | 3200 | 4 | achromatic black |
| Example 13 | 500 | 1.6 | 0.65 | 3250 | 3.8 | achromatic black |

As shown in Table 2, the second and third electrodes and the optional black matrix pattern formed in Examples 10–13 are in achromatic black, have a mirror reflectivity of 1.3% or greater, and have a diffused reflectivity of 0.5% or greater. The sheet resistance of the second and third electrodes and the black matrix pattern can be varied by adjusting the amount of the metal. The optical density of the second and third electrodes and the black matrix pattern is in the range of 4.1–4.5. It is evident that the reflectivity, the resistance, and the optical density characteristics of the black matrix pattern and the second and third electrodes are appropriate for a PDP.

For the front plates having the black matrix pattern and the second and third electrodes formed in Examples 10 through 13, the striped patterns of the black matrix pattern and the second and third electrodes were observed using an optical microscope. As a result of the observation, it is apparent that the black matrix pattern and the second and third electrodes have good surface flatness and may be formed as fine patterns.

The front plate, the method for fabricating the front plate, and the PDP using the front plate according to the present invention and as described above have the following features. First, the second and third electrodes and the optional black matrix pattern are deposited to form a gradient of the concentration profile of the metal and dielectric material that gives good thermal and chemical stability. Second, although an annealing process is not carried out in forming the electrodes and the black matrix on the plate member of the front plate, the second and third electrodes and the black matrix have good adhesiveness with respect to the plate member and good mechanical characteristics due to the absence of internal stress. Third, the black matrix and the second and third electrodes may be formed as fine patterns. Fourth, due to the external light absorption effects of the second and third electrodes and the black matrix, the PDP has improved contrast characteristics. The second and third electrodes and the black matrix can easily be made in various patterns. Fifth, since the black matrix and the second and third electrodes can be formed to have the same thickness, the surface flatness is improved and the level of the discharging voltage can be appropriately varied.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. A plate for a plasma display panel (PDP), comprising:

a plate member comprising a transparent material;

electrodes formed in a predetermined pattern on said plate member;

a dielectric layer formed on said plate member to cover said electrodes, wherein:

said electrodes comprise a dielectric first component and a second component, the second component comprising at least one metal selected from a group consisting of iron (Fe), cobalt (Co), vanadium (V), titanium (Ti), aluminum (Al), silver (Ag), silico (Si), germanium (Ge), yttrium (Y), zinc (Zn), zirconium (Zr), tungsten (W), tantalum (Ta), copper (Cu), and platinum (Pt), and amounts of the dielectric first component and the second components one of gradually change and stepwise change in a thickness direction of said electrodes extending away from said plate member.

2. The plate of claim 1, further comprising a black matrix pattern formed between adjacent pairs of said electrodes.

3. The plate of claim 1, wherein the dielectric first component comprises at least one dielectric material selected from a group consisting of SiOx, $MgF_2$, CaF2, $Al_2O_3$, $SnO_2$, $In_2O_3$, and indium thin oxide (ITO), where x>1.

4. The plate of claim 1, wherein the-amounts of the dielectric first component and the second components gradually change in thickness direction of said electrodes extending away from said plate member.

5. The plate of claim 1, wherein the amounts of the dielectric first component and the second components change in step gradients in a thickness direction of said electrodes extending away from said plate member.

6. The plate of claim 1, wherein the amounts of the dielectric first component and the second components gradually change in said electrodes as a function of distance from said plate member such that a ratio of light absorption of said electrodes gradually increases with increased distance from an external light entering side of said plate member.

7. The plate of claim 4, wherein the amounts of the dielectric first component and the second components gradually change in the thickness direction of said electrodes such that a refractive index of said electrodes gradually changes with increased distance from an external light entering side of said plate member.

8. The plate of claim 4, wherein the amount of the dielectric first component gradually decreases and the amount of the second component gradually increases with increased distance from an external light entering side of said plate member.

9. A plate for a plasma display panel (PDP), comprising:

a plate member comprising a transparent material;

electrodes formed in a predetermined pattern on said plate member;

a dielectric layer formed on said plate member to cover said electrodes;

a black matrix pattern formed between adjacent pairs of said electrodes, wherein:

said electrodes comprise a dielectric first component and a second component, the second component comprising at least one metal selected from a group consisting of iron (Fe), cobalt (Co), vanadium (V), titanium (Ti), aluminum (Al), silver (Ag), silico (Si), germanium (Ge), yttrium (Y), zinc (Zn), zirconium (Zr), tungsten (W), tantalum (Ta), copper (Cu), and platinum (Pt), and said black matrix pattern comprises the dielectric first component and the second components, and the amounts of the dielectric first component and the second components change in step gradients in a thickness direction of said black matrix pattern extending away from said plate member.

10. A plasma display panel (PDP comprising:

a back plate;

a transparent front plate bonded with said back plate with a predetermined separation gap to form a discharge space therebetween;

first electrodes and second electrodes arranged on a side of one of said back plate and said front plate to cause a discharge of a plasma;

third electrodes arranged within the discharge space and on a side of the other of said back plate and said front plate, and a discharge gas to fill the discharge space, wherein:

said first electrodes and said second electrodes comprise:

a dielectric first component, and a metallic second component of at least one metal selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt), and amounts of the dielectric first component and the second components one of gradually change and stepwise change in a thickness direction of said first and second electrodes extending into the discharge space.

11. The PDP of claim 10, wherein the first component comprises at least one dielectric material selected from a group consisting SiOx, $MgF_2$, $CaF_2$, $Al_2O_3$, $SnO_2$, $In_2O_3$, and ITO, where x>1.

12. The PDP of claim 10, wherein the amounts of the dielectric first component and the second components change in step gradients in a thickness direction of said first and second electrodes extending into the discharge space.

13. The PDP of claim 11, wherein the amounts of the dielectric first component and the second components gradually change in thickness direction of said first and second electrodes extending into the discharge space.

14. A plasma display panel (PDP) comprising:

a back plate;

first electrodes formed in a predetermined pattern on said back plate;

a transparent front plate bonded with said back plate having said first electrodes to form a discharge space therebetween;

second and third electrodes formed a side of said front plate opposite said first electrodes and at a predetermined angle with respect to a direction of said first electrodes;

a barrier to partition the discharge space between said back plate an said front plate;

a first dielectric layer formed on said back plate to cover said first electrodes;

a second dielectric layer formed on said front plate to cover said second and third electrodes; and a black matrix pattern formed between adjacent pairs of said second and third electrodes on the side of said front plate, wherein:

said black matrix pattern and one of said first electrodes, said second electrodes, and said third electrodes is formed of a dielectric first component and a metallic second component, the second component comprising at least one metal selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt), and the amounts of the first and second components gradually change in a thickness direction of said first and second electrodes and said black matrix pattern extending into the discharge space.

15. The PDP of claim 14, wherein the first component comprises at least one dielectric material selected from a group consisting of SiOx, $MgF_2$, $CaF_2$, $Al_2O_3$, $SnO_2$, $In_2O_3$, and ITO, where x>1.

16. The PDP of claim 15, wherein the amounts of the dielectric first component and the second components change in step gradients in the thickness direction of said first and second electrodes and said black matrix pattern extending into the discharge space.

17. A plasma display panel (PDP) comprising:

a back plate;

first electrodes formed in a predetermined pattern on said back plate;

a transparent front plate bonded with said back plate having said fir electrodes to form a discharge space therebetween;

second and third electrodes formed on a side of said front plate opposite said first electrodes and at a predetermined angle with respect to a direction of said first electrodes;

a barrier to partition the discharge space between said back plate an said front plate;

a first dielectric layer formed on said back plate to cover said first electrodes;

a second dielectric layer formed on said front plate to cover said second and third electrodes; and a black matrix pattern formed between adjacent pairs of said second and third electrodes on the side of said front plate, wherein:

said black matrix pattern and one of said first electrodes, said second electrodes, and said third electrodes is formed of a dielectric first component and a metallic second component, the second component comprising at least one metal selected from a group consisting of iron (Fe), cobalt (Co), vanadium (V), titanium (Ti), aluminum (Al), silver (Ag), silicon (Si), germanium (Ge), yttrium (Y), zind (Zn), zirconium (Zr), tungsten (W), tantalum (Ta), copper (Cu), and platinum (Pt), and each of said second and third electrodes comprises a single electrode having a meshed pattern defining a plurality of apertures.

18. The PDP of claim 17, wherein the meshed patter comprises a plurality of parallel main electrode portions and a plurality of connect electrode portions connecting the parallel main electrode portions at a predetermined angle to define the plurality of apertures.

19. A plasma display panel (PDP) comprising:

a back plate;

first electrodes formed in a predetermined pattern on said back plate;

a transparent front plate bonded with said back plate having said firs electrodes to form a discharge space therebetween;

second electrodes and third electrodes formed on a side of said front late opposite said first electrodes and at a predetermined angle with respect to a direction of said first electrodes;

a barrier to partition the discharge space between said back plate and said front plate;

a first dielectric layer formed on said back plate to cover said first electrodes;

a second dielectric layer formed on said front plate to cover said second and third electrodes; and a black matrix pattern formed between adjacent pairs of said second and third electrodes on the side of said front plate; and an auxiliary indium tin oxide (ITO) electrode having a predetermine width and extending from each of said second and third electrodes, wherein said black matrix pattern and one of said first electrodes, said second electrodes, and said third electrodes is formed of a dielectric first component and a metallic second component, the second component comprising at least one metal selected from a group consisting of iron (Fe), cobalt (Co), vanadium (V), titanium (Ti), aluminum (Al), silver (Ag), silicon (Si), germanium (Ge), yttrium (Y), zinc (Zn), zirconium (Zr), tungsten (W), tantalum (Ta), copper (Cu), and platinum (Pt).

20. A plasma display panel (PDP) comprising:

a back plate;

first electrodes formed in a predetermined pattern on said back plate;

a transparent front plate bonded with said back plate having said first electrodes to form a discharge space therebetween;

second electrodes and third electrodes formed on one side of said front plate opposite said first electrodes at a predetermined angle with respect to a direction of said first electrodes;

a barrier to partition the discharge space between said back plate an said front plate;

a first dielectric layer formed on said back plate to cover said first electrodes;

a second dielectric layer formed on said front plate to cover said second and third electrodes; and a black matrix pattern formed between adjacent pairs of said second and third electrodes on the one side of said front plate, wherein:

said black matrix pattern and one of said first electrodes, said second electrodes, and said third electrodes comprise a dielectric material and a conductive metal, and amounts of the dielectric material and the conductive metal change in a thickness direction of said first, second, third electrodes and said black matrix pattern extending into the discharge space.

21. A plate for a plasma display panel (PDP), comprising:

a plate member comprising a transparent material;

an electrode on said plate member, wherein said electrode has a refractive index which varies one of gradually and stepwise as a function of thickness so as to absorb external light passing through said plate member; and a dielectric layer to cover said plate member and said electrode.

22. The plate of claim 21, wherein said electrode variably refracts the external light passing through said electrode to absorb the external light.

23. The plate of claim 21, wherein said electrode as an achromatic black quality.

24. The plate of claim 21, wherein the refractive index changes with increased distance from an external light entering side of said late member.

25. The plate of claim 21, wherein the refractive index changes due to a change in relative concentration of a metallic component and a dielectric component as a function of thickness.

26. The plate of claim 24, wherein the refractive index increases with increased distance from the external light entering side of said plate member.

27. The plate of claim 25, wherein, as a function of thickness within said electrode, a concentration profile of the metallic component is the reciprocal of a concentration profile of the dielectric component.

28. A plate for a plasma display panel (PDP), comprising:

a plate member comprising a transparent material;

an electrode on said plate member, wherein said electrode absorbs external light passing through said plate member; and a dielectric layer to cover said plate member and said electrode, wherein said electrode comprises a mixture of components having relative amounts that vary within portions of said electrode to vary a refractive index within a thickness of said electrode.

* * * * *

UNITED STATES PATENT AND TRADEMARK OFFICE

CERTIFICATE OF CORRECTION

PATENT NO. : 6,674,237 B2
DATED : January 6, 2004
INVENTOR(S) : Young-Rag Do et al.

It is certified that error appears in the above-identified patent and that said Letters Patent is hereby corrected as shown below:

Column 13,
Lines 7 and 58, change “silico” to -- silicon --.
Lines 11, 26, 30, 36 and 63, change “components” to -- component --.
Line 61, delete the word “and”.

Column 14,
Line 1, change “(PDP” to -- (PDP) --.
Lines 25, 34 and 38, change “components” to -- component --.
Line 54, change “an” to -- and --.

Column 15,
Line 14, change “components” to -- component --.
Line 30, change “an” to -- and --.
Line 23, change “fir” to -- first --.
Line 52, change “patter” to -- pattern --.
Line 62, change “firs” to -- first --.
Line 65, change “late” to -- plate --.

Column 16,
Line 11, change “predetermine” to -- predetermined --.
Line 36, change “an” to -- and --.

Signed and Sealed this

Sixteenth Day of March, 2004

JON W. DUDAS
*Acting Director of the United States Patent and Trademark Office*